US006113444A

United States Patent [19]

Ritger

[11] Patent Number: 6,113,444

[45] Date of Patent: Sep. 5, 2000

[54] STEERING MECHANISM FOR AN OUTBOARD MOTOR

[75] Inventor: Bernard E. Ritger, Fond du Lac, Wis.

[73] Assignee: Brunswick Corporation, Lake Forest, Ill.

[21] Appl. No.: 09/327,280

[22] Filed: Jun. 4, 1999

[51] Int. Cl.[7] ..... B63H 5/125

[52] U.S. Cl. ..... 440/61

[58] Field of Search ..... 440/53, 61, 5; 114/150

[56] References Cited

U.S. PATENT DOCUMENTS

| | | | |
|---|---|---|---|
| 3,426,652 | 2/1969 | Blake | 92/97 |
| 3,587,511 | 6/1971 | Buddrus | 440/5 |
| 3,596,626 | 8/1971 | Buddrus | 440/5 |
| 3,673,978 | 7/1972 | Jeffery et al. | 440/5 |
| 3,847,107 | 11/1974 | Buddrus | 440/5 |
| 3,915,111 | 10/1975 | Buddrus | 440/5 |
| 4,422,366 | 12/1983 | Weyer | 91/26 |
| 5,038,066 | 8/1991 | Pawlak et al. | 310/263 |
| 5,702,275 | 12/1997 | Hundertmark | 440/61 |

OTHER PUBLICATIONS

Brochure of the Helac Corporation.

*Primary Examiner*—Stephen Avila
*Attorney, Agent, or Firm*—William D. Lanyi

[57] ABSTRACT

A rotary actuator is used to steer a watercraft with an outboard motor. First and second brackets are attached to the outboard motor and the transom of the watercraft, respectively. The rotary actuator can be a hydraulic rotary actuator and either the rotor portion or stator portion of the rotary actuator can be attached to the outboard motor with the other portion being attached to the transom. A hydraulic pump is used to provide pressurized fluid to the actuator and a valve is used to selectively direct the pressurized fluid to one of two ports in the rotary actuator to select the directional rotation and speed between the stator portion and the rotor portion.

3 Claims, 3 Drawing Sheets

STEERING MECHANISM FOR AN OUTBOARD MOTOR

BACKGROUND OF THE INVENTION

1. Field of the Invention

The present invention is generally related to steering mechanisms for an outboard motor and, more particularly, to a steering mechanism that utilizes a rotary actuator disposed around the steering axis of an outboard motor.

2. Description of the Prior Art

Many different steering mechanisms are well known to those skilled in the art. In addition to manual steering with a tiller handle, several mechanical steering systems have been used. For example, it is common to use steel cables connected to both the outboard motor and a steering wheel to allow an operator to manually rotate an outboard motor about its vertical steering axis by turning a steering wheel. Hydraulic systems are also well known to those skilled in the art, in which a hydraulic piston exerts a force against a steering bracket to move an outboard motor about its steering axis. Various types of power steering systems also use hydraulic cylinders in this general way. Rotary actuators are well known to those skilled in the art and it is also known that rotary actuators can be driven either by hydraulic power or electrical power.

U.S. Pat. No. 4,422,366, which issued to Weyer on Dec. 27, 1983, discloses a rotary helical actuator. The helically splined hydraulic actuator is provided with hydraulic cushioning and rapid initiation of movement. The actuator is provided with an elongated cylindrical bearing integral with the shaft of the actuator for increasing radial and movement load-carrying capacity of the actuator without increasing its length.

U.S. Pat. No. 5,038,066, which issued to Pawlak et al on Aug. 6, 1991, describes a claw pole rotary actuator with a limited angular movement. The actuator has a permanent magnet ring with a plurality of radially magnetized poles rotatably positioned between a pair of toothed pole pieces with interdigitated teeth, an electromagnetic coil and pole elements coupling the coil flux to the pole pieces. The pole pieces may themselves be rotatable or stationary. The permanent magnet circuit attempts to move the magnet ring to a first position relative to the pole pieces, and the electromagnetic circuit, depending on the direction of current in the coil, torques the magnet in one direction or another toward stable positions on either side of the first position. The device is used as a two or three position actuator or as an actuator operating against an external force and seeking a position as a function of current.

U.S. Pat. No. 3,426,652, which issued to Blake on Feb. 11, 1969, describes a rotary hydraulic actuator with locking means. A rotary fluid actuator in which a rotor is mounted coaxially with a pressure cylinder with an annular pressure chamber extending around the rotor and divided into subchambers by vanes rigidly mounted on the rotor and cylinder. A fail-safe locking means carried by the rotor automatically locks the rotor against rotation within the cylinder upon the absence of fluid pressure within the annular pressure chamber. Application of fluid pressure tending to rotate the rotor releases the locking means.

U.S. Pat. No. 3,587,511, which issued to Buddrus on Jun. 28, 1971, describes a hydraulic marine propulsion system. The hydraulic propulsion system features an inboard power plant and fluid pressure-generating system and an outboard fluid driving system. The inboard pressure-generating system consists of a reversible variable displacement axial piston pump, a lever-operated servosystem, a speed control, a charge pump, and valve manifold units. The outboard fluid-driving system consists of a fixed displacement axial piston fluid motor and propeller.

U.S. Pat. No. 3,847,107, which issued to Buddrus on Nov. 12, 1974, describes a hydraulic marine propulsion and guidance system. The propulsion and guidance system consists of a fluid pressure generating system and a helm pressure generating unit located within the vessel. It also comprises a tilting fluid actuator mounted to the transom of the vessel, a lift clevis operatively connected to the shaft of the tilting actuator, a rotary fluid actuator mounted within the lift clevis, a steering clevis operatively connected to the shaft of the rotary fluid actuator, a fluid motor-propeller assembly secured to the steering clevis, an additional fluid pump located within the vessel and fluid conduit operatively connecting it to the tilting actuator such that as the pump is operated the shaft of the tiled actuator rotates the lift clevis in turn tilting the fluid motor-propeller assembly. It further comprises fluid conduit which operatively connects the helm pressure generating unit and the rotary actuator such that as the helm pressure generating unit is operated the shaft of the rotary actuator rotates the steering clevis and the fluid motor-propeller assembly. The fluid conduit includes single passage oscillating swivels mounted to the transom along a common axis defining the center of rotation of the lift clevis. The system further comprises fluid conduit which connects the fluid pressure generating system and the fluid motor including a multiple passage oscillating swivel operatively mounted to the steering clevis and aligned with respect to the axis of rotation of the steering clevis. The swivels permit the use of rigid fluid connections throughout the system.

U.S. Pat. No. 3,673,978, which issued to Jeffery et al on Jul. 4, 1972, discloses an outboard drive unit for boats. An outboard propulsion drive unit for a boat with an inboard engine utilizes a hydraulic pump on the engine hydraulically connected with a universal swivel mounting which receives an outboard propulsion unit to provide steering about a generally vertical axis and up-tilt motion about a transverse horizontal axis. The swivel mounting has a pair of hydraulic conduits extending through the bearing journals of both axes. The propulsion unit has a hydraulic motor geared to drive the propeller. A reservoir and a charging pump are mounted in the propulsion unit, the latter being driven by the hydraulic motor.

U.S. Pat. No. 3,596,626, which issued to Buddrus on Aug. 3, 1971, describes a steering and tilting system for marine vessels. The steering and tilting systems feature hydraulic actuators. The steering system comprises two self-contained units including a first helm pressure generating assembly positioned as desired within the vessel and a second hydraulic rotary actuator assembly suitably mounted to the vessel guidance system. The tilting system also comprises two self-contained units including a first motor driven hydraulic pump positioned as desired within the vessel and a second hydraulic actuator assembly suitably mounted to the underwater propulsion system.

Many different types of rotary actuators are known to those skilled in the art. The Helac Corporation provides a series of hydraulic rotary actuators. These hydraulic rotary actuators can be of the helical rotary actuator type or the planetary hydraulic rotary actuator type. Various types of helical shaft actuators, helical pivot actuators, ball bearing actuators, and planetary actuators are available in commercial quantities.

SUMMARY OF THE INVENTION

A steering system for an outboard motor, made in accordance with the preferred embodiment of the present invention, comprises a first bracket attached to an outboard motor and a second bracket attached to a transom of a boat. The outboard motor, as that term is used in the following description, means a marine propulsion unit that is separable from a boat and attachable to the transom of a boat, but which does not extend through openings formed in the transom in a way similar to a stem drive propulsion unit. The outboard motor, as is known to those skilled in the art, is typically attached to a transom through the use of clamps or bolts extending through the transom. The outboard motor is generally attached in a way that allows it to be rotated about a generally vertical steering axis and moved in a tilting or trimming position about a generally horizontal axis that extends in a generally parallel relation with the transom of the boat.

A preferred embodiment of the present invention further comprises a rotary actuator that, in turn, comprises a stator portion and a rotor portion. The stator portion is shaped to receive the rotor portion in rotatable association therein. The stator portion is attached to a preselected one of the first and second brackets and the rotor portion is attached to the other one of the first and second brackets. In other words, the stator portion can be attached to the first bracket which is attached to the outboard motor or, alternatively, the stator portion can be attached to the second bracket which is attached to the transom of the boat. The rotor portion is attached to the other bracket to which the stator portion is not attached.

When the stator portion is attached to the first bracket, it rotates with the outboard motor while the rotor portion is stationary because of its attachment to the second bracket which is attached to the transom of the boat. Alternatively, when the rotor portion is attached to the first bracket, it rotates with the outboard motor and the stator portion remains stationary because of its attachment to the second bracket which is attached to the transom of the boat.

In a preferred embodiment of the present invention, the rotary actuator is a hydraulic rotary actuator. The steering system then further comprises a hydraulic pump and a valve connected in fluid communication with the pump. The valve selectively connects the pump in fluid communication with the first or second ports of the hydraulic actuator in order to determine a rotational direction of the rotor portion relative to the stator portion. The steering system of the present invention can further comprise a steering wheel that is connected in electrical or hydraulic communication with the valve to cause the valve to selectively connect the pump in fluid communication with said first or second ports of the hydraulic actuator to determine a rotational direction and speed of the rotor portion relative to the stator portion.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
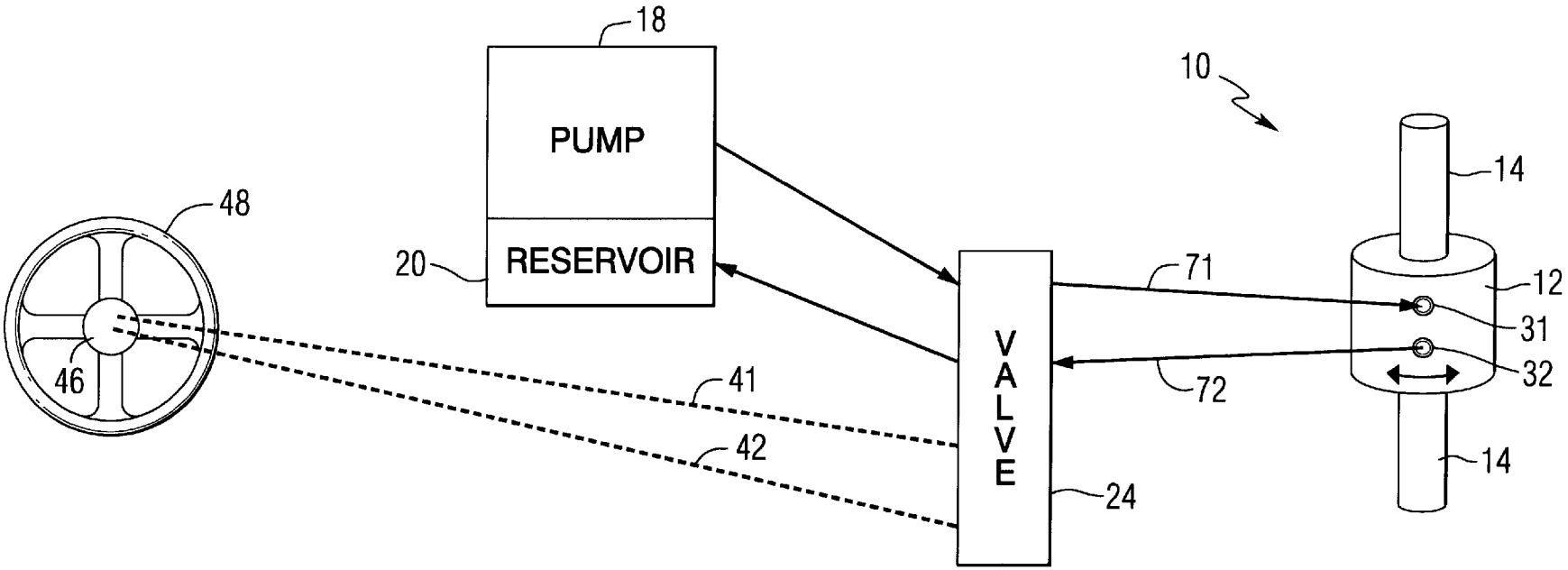
FIG. 1 is a schematic illustration of a steering system incorporating the principles of the present invention.

Throughout the description of the preferred embodiment, like reference numerals will be used to describe like components.

FIG. 1 is a simplified schematic representation of a steering system made in accordance with the present invention. A rotary actuator 10 comprises a stator portion 12 and a rotor portion 14. The rotor portion 14 is rotatable relative to the stator portion 12 and the stator portion 12 is shaped to receive the rotor portion 14 in rotatable association therein. The rotary actuator 10 in FIG. 1 is illustrated as a hydraulic rotatable actuator. Hydraulic pressure is provided by a pump 18 with an oil reservoir 20. The valve 24 directs pressurized fluid from the pump 18 to either a first port 31 or second port 32. The reservoir 20 is connected, through valve 24, to either the first or second ports, 31 or 32, depending on the internal position of the valve components. Many different types of valve 24 are known to those skilled in the art. The only limitation of the valve 24 used in conjunction with the present invention is that it must be able to take pressurized fluid from the pump 18 and direct it selectively to either the first or second ports, 31 or 32. When the valve 24 directs pressurized fluid into the first port 31, it causes relative rotational movement between the rotor 14 and stator 12 in a first direction. When the valve 24 causes the pressurized fluid to flow into the second port 32, the relative motion between the stator 12 and rotor 14 is reversed. The pump 18 draws fluid from the reservoir 20.

With continued reference to FIG. 1, the valve 24 is controlled by signals received from a steering mechanism 46 of a steering wheel 48. Signals on lines 41 and 42 respond to the rotational position of the steering wheel 48 and determine the internal configuration of the valve 24. In turn, these signals determine whether the pressurized fluid from the pump 18 is directed to the first port 31 or the second port 32. As a result, the rotational position of the stator 12 with respect to the rotor 14 is determined by the rotational position of the steering wheel 48.

The system shown in FIG. 1 represents a use of a hydraulic rotary actuator 10. It should be understood that other types of rotary actuators 10 can be used in conjunction with the present invention.

Figure 2:
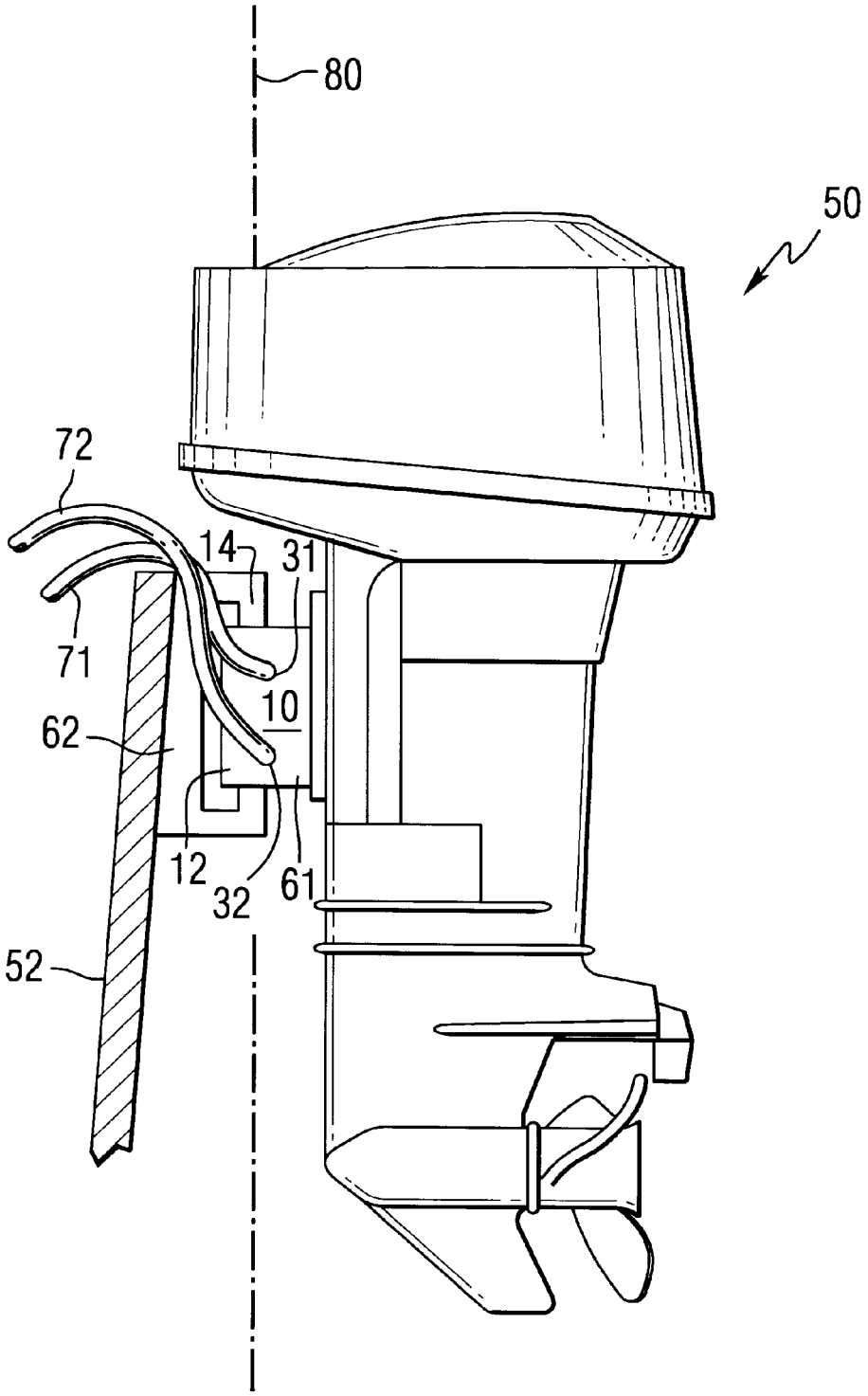
FIG. 2 is one embodiment of the present invention.

FIG. 2 shows an outboard motor 50 attached to a transom 52 of a boat. A first bracket 61 is attached to the outboard motor 50 and a second bracket 62 is attached to the transom 52. In the embodiment shown in FIG. 2, a stator portion 12 of the rotary actuator is attached to the first bracket 61 and a rotor portion 14 is attached to the second bracket 62. As described above, the stator portion 12 and the rotor portion 14 are rotatable relative to each other.

The embodiment shown in FIG. 2 comprises a hydraulic rotary actuator 10 that has a first port 31 and a second port 32. Hoses, 71 and 72, are shown connected to the first and second ports, 31 and 32, respectively. Although not shown in FIG. 2, the hoses, 71 and 72, are connected to a valve 24 which, in turn, is connected to a pump 18 as described above in conjunction with FIG. 1. By providing pressure from the pump 18 to either hose 71 or hose 72, the pressure can be provided to the hydraulic rotary actuator 10 through either its first or second port, 31 or 32, to selectively cause the first bracket 61 to rotate relative to the second bracket 62. This, in turn, causes the outboard motor 50 to rotate about a generally vertical steering axis 80. It should be recognized that in certain applications the steering axis 80 is not precisely vertical. Since the present invention is not directly related to the tilting or trimming capabilities of the outboard motor 10, the trim system is not illustrated in FIG. 2. However, as is well known to those skilled in the art, the outboard motor 50 is generally made trimable about a trim axis that is generally horizontal and generally parallel to the surface of the transom 52. That trim axis is perpendicular to the drawing in FIG. 2.

Figure 3:
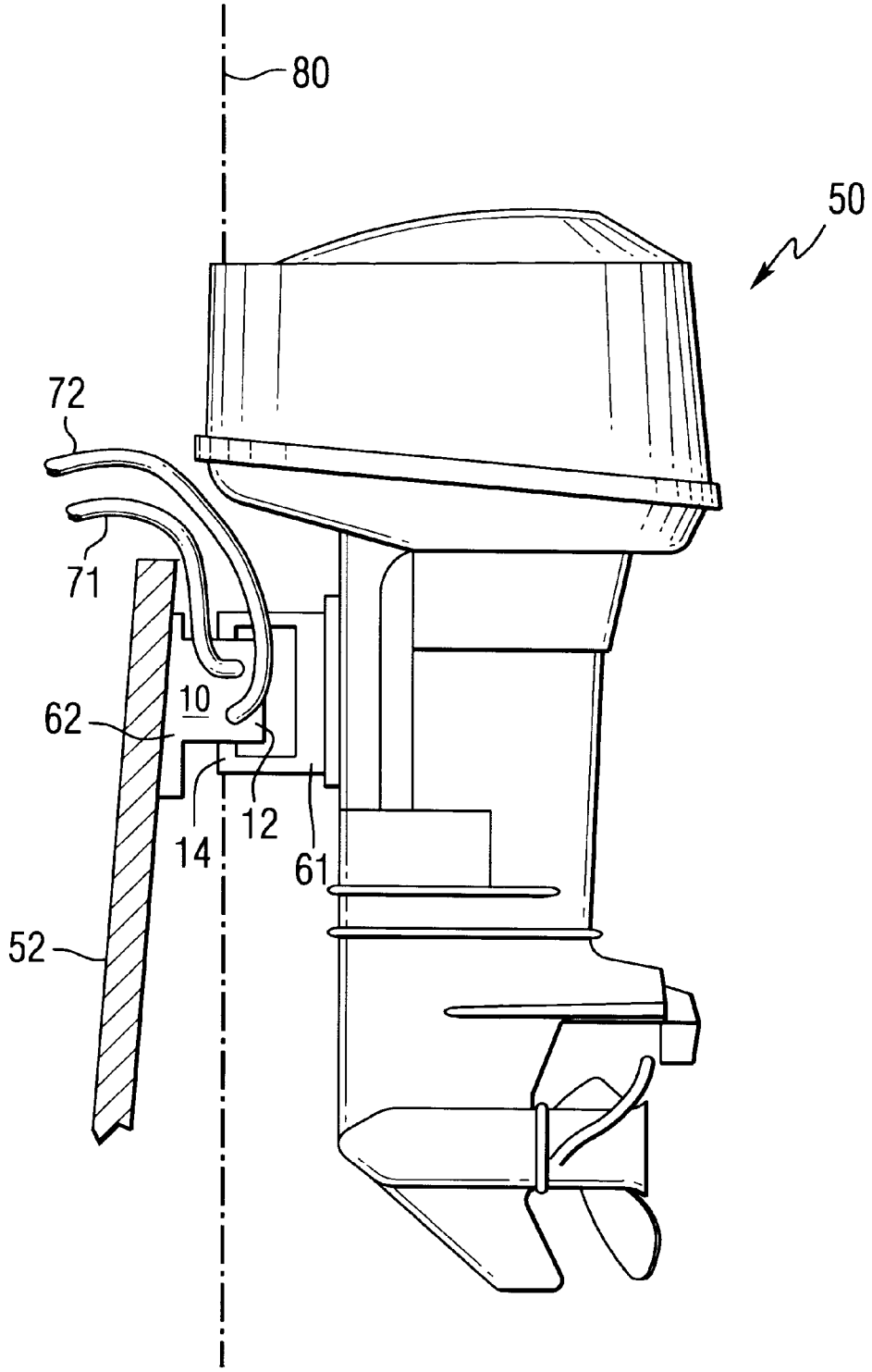
FIG. 3 is an alternative embodiment of the present invention.

FIG. 3 shows an alternative embodiment of the present invention. The embodiment of FIG. 3 is generally similar to that of FIG. 2 except with respect to the basic connections of the rotor 14 and stator 12 portions of the hydraulic rotary actuator to the first and second brackets, 61 and 62. In FIG. 3, the rotor portion 14 is attached to the first bracket 61 and the stator portion 12 is attached to the second bracket 62. This connects the outboard motor 50 to the rotor portion 14, which is rotatable about steering axis 80 while the stator portion 12 is stationary and attached to the second bracket 62. The basic operation is the same as the embodiment in FIG. 2. By directing pressurized fluid selectively through either hose 71 or hose 72, the hydraulic rotary actuator 10 causes the rotor 14 to rotate relative to the stator portion 12. Steering is accomplished by a system such as that described in conjunction with FIG. 1.

FIGS. 1, 2 and 3 illustrate two of many possible embodiments of the present invention. The use of a rotary actuator 10 allows the outboard motor 50 to be rotated for purposes of steering without the necessity of a plurality of hydraulic cylinders and linkages to accomplish this purpose. The rotary actuator can be hydraulic, as illustrated in the Figures, or can be an electrical rotary actuator as described above in conjunction with the prior art.

Although the present invention has been described with particular detail and illustrated to show a preferred embodiment, it should be understood that other embodiments are also within its scope.

I claim:

1. A steering system for an outboard motor, comprising:

a first bracket attached to said outboard motor;

a second bracket attached to a transom of a boat;

a rotary actuator comprising a stator portion and a rotor portion, said stator being shaped to receive said rotor portion in rotatable association therein, said stator portion being attached to a preselected one of said first and second brackets, said rotor portion being attached to the other of said first and second brackets, said rotary actuator is a hydraulic rotary actuator;

a hydraulic pump;

a valve connected in fluid communication with said pump, said valve selectively connecting said pump in fluid communication with first or second ports of said hydraulic actuator to determine a rotational direction of said rotor portion relative to said stator portion; and a steering wheel connected in electrical communication with said valve to cause said valve to selectively connect said pump in fluid communication with said first or second ports of said hydraulic rotary actuator to control a rotational direction of said rotor portion relative to said stator portion.

2. The steering system for an outboard motor of claim 1, wherein:

said stator portion is attached to said first bracket and said rotor portion is attached to said second bracket.

3. The steering system for an outboard motor of claim 1, wherein:

said rotor portion is attached to said first bracket and said stator portion is attached to said second bracket.

* * * * *